US010377130B2

(12) United States Patent
Holstun et al.

(10) Patent No.: US 10,377,130 B2
(45) Date of Patent: Aug. 13, 2019

(54) MITIGATING DAMAGE TO DROP GENERATORS IN A PRINTING SYSTEM

(71) Applicant: HEWLETT-PACKARD DEVELOPMENT COMPANY, L.P., Houston, TX (US)

(72) Inventors: Clayton L Holstun, San Marcos, CA (US); Joshua A Mann, Ramona, CA (US); Lisa A Underwood, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/303,952

(22) PCT Filed: Apr. 24, 2014

(86) PCT No.: PCT/US2014/035289
§ 371 (c)(1),
(2) Date: Oct. 13, 2016

(87) PCT Pub. No.: WO2015/163884
PCT Pub. Date: Oct. 29, 2015

(65) Prior Publication Data
US 2017/0036441 A1 Feb. 9, 2017

(51) Int. Cl.
*B41J 2/045* (2006.01)
*B41J 29/393* (2006.01)
*B41J 2/165* (2006.01)
*B41J 2/21* (2006.01)

(52) U.S. Cl.
CPC ..... *B41J 2/0451* (2013.01); *B41J 2/0458* (2013.01); *B41J 2/04513* (2013.01);
(Continued)

(58) Field of Classification Search
CPC .... B41J 2/0451; B41J 2/04586; B41J 2/2146; B41J 2/16585; B41J 2/2135; B41J 2/0458;
(Continued)

(56) References Cited

U.S. PATENT DOCUMENTS 5,581,284 A 12/1996 Hermanson
6,354,687 B1 3/2002 Su et al.
(Continued)

FOREIGN PATENT DOCUMENTS

CN 1796121 7/2006
CN 1868746 11/2006
(Continued)

OTHER PUBLICATIONS

Avedisian et al.; Measuring Bubble Nucleation Temperature on the Surface of a Rapidly Heated Thermal Ink-jet Heater Immersed in a Pool of Water; Proceedings of the Royal Society: Nov. 8, 1999: vol. 455 No. 1991 3875-3899.

*Primary Examiner* — Yaovi M Ameh
(74) *Attorney, Agent, or Firm* — Mannava & Kang

(57) ABSTRACT

According to an example, in a method for mitigating damage to a plurality of drop generators in a printing system, data corresponding to an image to be printed on a media by the printing system may be accessed. In addition, the plurality of drop generators may be controlled to print the image on the media while mitigating damage to the plurality of drop generators and without shifting placement of the image on the media or shifting the plurality of drop generators in a direction perpendicular to a feed direction of the media.

15 Claims, 7 Drawing Sheets

(52) U.S. Cl.
CPC ..... *B41J 2/04536* (2013.01); *B41J 2/04573* (2013.01); *B41J 2/04581* (2013.01); *B41J 2/04586* (2013.01); *B41J 2/16585* (2013.01); *B41J 2/2135* (2013.01); *B41J 2/2146* (2013.01); *B41J 29/393* (2013.01)

(58) Field of Classification Search
CPC ..... B41J 2/04581; B41J 2/04573; B41J 2/04536; B41J 2/04513; B41J 29/393
See application file for complete search history.

(56) References Cited

U.S. PATENT DOCUMENTS

| | | | | |
|---|---|---|---|---|
| 7,474,321 | B2 | 1/2009 | Wiens | |
| 7,533,965 | B2 | 5/2009 | Steiner | |
| 2006/0087531 | A1 | 4/2006 | Eiseman et al. | |
| 2006/0125850 | A1 | 6/2006 | Kim et al. | |
| 2006/0139394 | A1* | 6/2006 | Wada | B41J 2/2139 347/19 |
| 2006/0274111 | A1 | 12/2006 | Cho | |
| 2007/0109352 | A1 | 5/2007 | Yagi et al. | |
| 2010/0134545 | A1* | 6/2010 | Murai | B41J 2/155 347/13 |
| 2011/0316911 | A1* | 12/2011 | Ishikawa | G06K 15/107 347/9 |
| 2012/0044297 | A1* | 2/2012 | Yazawa | B41J 2/2132 347/43 |

FOREIGN PATENT DOCUMENTS

| | | |
|---|---|---|
| JP | 2013225172 | 10/1931 |
| JP | 2003170577 | 6/2003 |
| JP | 201000680 | 1/2010 |
| JP | 2013173313 | 9/2013 |

* cited by examiner

MITIGATING DAMAGE TO DROP GENERATORS IN A PRINTING SYSTEM

BACKGROUND

Some commercial products such as printers, graphics plotters, copiers, and facsimile machines may employ thermal ink-jet printing or piezoelectric printhead technology. Thermal ink-jet printing technology typically includes the repeated heating of resistors to fire ink through a plurality of nozzles onto a media. Piezoelectric printhead technology typically includes the repeated actuation of piezoelectric elements to fire ink through a plurality of nozzles onto a media. In some products, the firing elements, e.g., resistors or piezoelectric elements, are arranged in printheads, in which the printheads are smaller in width than the media and are to be scanned across the media. In these types of products, the firing elements are activated at appropriate times as the printheads are scanned one or more times across the media to cause a desired image to be formed on the media. Printing during multiple scans across the media enables printing fluid to be deposited at their desired locations through any of a number of nozzles. In one regard, therefore, in scanning printhead type of products, an operational firing element may be used to deposit ink at a particular location in place of a defective firing element.

In other products, such as page wide printers, the firing elements are arranged in printheads, in which the printheads are similar to or larger in width than the media. In these types of products, the firing elements are activated at appropriate times to cause printing fluid to be deposited at desired locations on the media during a single pass of either the printheads with respect to the media or the media with respect to the printheads. Typically, the printheads in page wide printers remain fixed while the media moves in a particular direction beneath the printheads.

BRIEF DESCRIPTION OF THE DRAWINGS

Features of the present disclosure are illustrated by way of example and not limited in the following figure(s), in which like numerals indicate like elements, in which.

DETAILED DESCRIPTION

Figure 1A:
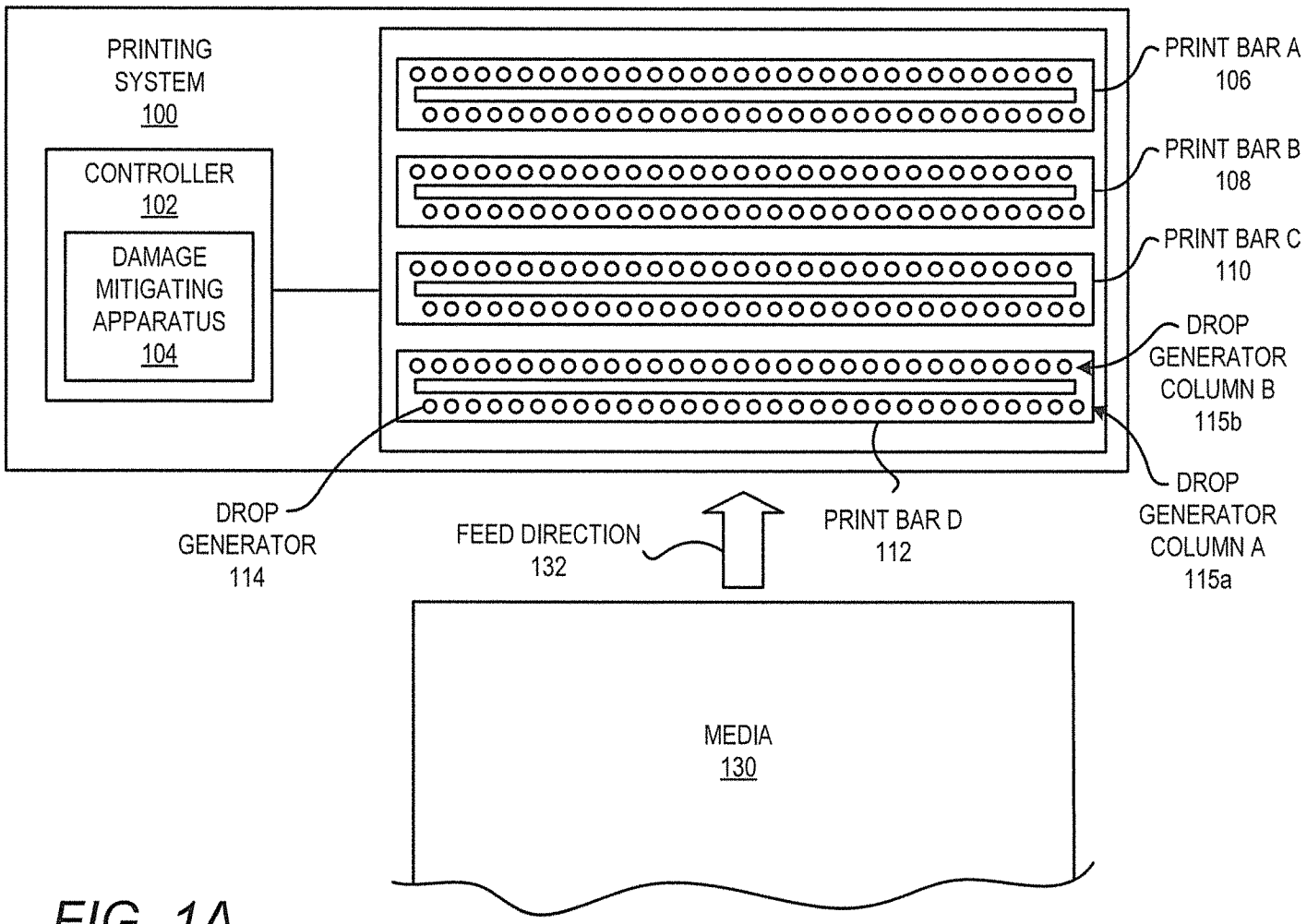
FIG. 1A is a simplified diagram of a printing system, which may implement various aspects of the methods disclosed herein, according to an example of the present disclosure.

For simplicity and illustrative purposes, the present disclosure is described by referring mainly to an example thereof. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure. As used herein, the terms "a" and "an" are intended to denote at least one of a particular element, the term "includes" means includes but not limited to, the term "including" means including but not limited to, and the term "based on" means based at least in part on.

Disclosed herein are methods for mitigating damage to a plurality of drop generators in a printing system and apparatuses for implementing the methods. In the methods, data corresponding to an image to be printed on a media by the printing system may be accessed. The data may include data that has been processed for printing, e.g., processed through an imaging pipeline where the data is color mapped, halftoned, linearized, swath cut, etc. In addition, the plurality of drop generators may be controlled to print the image on the media while mitigating damage to the plurality of drop generators and without shifting placement of the image on the media or shifting the plurality of drop generators in a direction perpendicular to a feed direction of the media. Various manners in which damage to the plurality of drop generators may be mitigated are disclosed herein.

As discussed herein, a drop generator, such as a piezoelectric element or a resistor, may be construed as being damaged if the drop generator has stopped functioning properly. That is, a drop generator may be construed as being damaged if the drop generator is unable to fire a drop of printing fluid through a nozzle or if the drop generator is only able to fire a drop of printing fluid that is relatively smaller than a nominally sized drop, i.e., a drop size corresponding to a properly functioning drop generator. In addition, a drop generator, such as a resistor, may be construed as being damaged if the drop generator has been burned-in. As used herein, "burn-in" of a drop generator may be defined as an uneven wearing of the drop generator as compared with other drop generators in the printing system, as may occur when the drop generator is used a significantly larger number of times as compared to the other drop generators to print portions of images. That is, a drop generator may experience "burn-in" or uneven wearing when that drop generator is activated much more often than neighboring drop generators. One result of burn-in may be that the burnt-in drop generator(s) may be unable to eject a nominal or normal amount of printing fluid. This inability to cause a nominal amount of printing fluid to be ejected may cause the drop generator(s) to drop printing fluid that is sized differently than the printing fluids dropped by its neighboring drop generators. For instance, a burnt-in drop generator may drop a smaller sized drop of printing fluid or a larger sized drop of printing fluid than its neighboring drop generators. In addition, in printing systems in which the same drop generators are responsible for printing along the same line in a feed direction of the media, such as printing systems in which the drop generators are not a lighter or darker band may be printed by the damaged, e.g., burnt-in, drop generators as compared with their neighboring drop generators that are operating nominally. Thus, for instance, the sections of an image printed by the damaged drop generators may appear as a lighter or darker band within the sections of the image printed by neighboring drop generators that have experienced a lesser degree of damage or are less worn.

By way of example, a set of drop generators may experience damage, e.g., burn-in, if the set of drop generators are employed to print relatively long lines in a feed direction of a media. This may occur in engineering drawings which often include long borders that extend from nearly one edge to an opposite edge of a media.

Through implementation of the methods and apparatuses disclosed herein, damage to a plurality of drop generators may be mitigated through prevention or delay of the onset of the damage. In addition, or alternatively, the effects of the damage to the drop generators may be mitigated through drop generator control operations that may substantially avoid use of the damaged drop generators, for instance, to print filled in sections of images. Moreover, the mitigation may be provided as an image processing pipeline solution in that the methods and the apparatuses disclosed herein may be implemented without shifting the placement of the image on the media or shifting a position of the drop generators in a direction that is perpendicular to the feed direction of the media. Instead, the mitigation may occur in the image processing pipeline of the printing system.

With reference first to FIG. 1A, there is shown a simplified schematic diagram of a printing system 100, which may implement various aspects of the methods disclosed herein, according to an example. It should be understood that the printing system 100 depicted in FIG. 1A may include additional elements and that some of the elements depicted therein may be removed and/or modified without departing from a scope of the printing system 100.

As shown in FIG. 1A, the printing system 100 may include a controller 102 and a number of print bars 106-112, which may equivalently be denoted as die, printheads, etc. Although the print bars 106-112 have been depicted as each including single components, the print bars 106-112 may instead be formed of multiple modules. Each of the print bars 106-112 may be supplied with different colored printing fluids, such as inks, dyes, etc., to be ejected from the print bars 106-112. For instance, a first print bar 106 may be supplied with a black colored printing fluid, a second print bar 108 may be supplied with a cyan colored printing fluid, a third print bar 110 may be supplied with a magenta colored printing fluid, and a fourth print bar 112 may be supplied with a yellow colored printing fluid. In other examples, the printing system 100 may include additional print bars that are supplied with differently colored printing fluids and/or each of the print bars 106-112 may be formed of multiple modules. In yet other examples, the printing system 100 may include a single print bar 106, for instance, that is to print a black colored printing fluid.

Figure 1B:
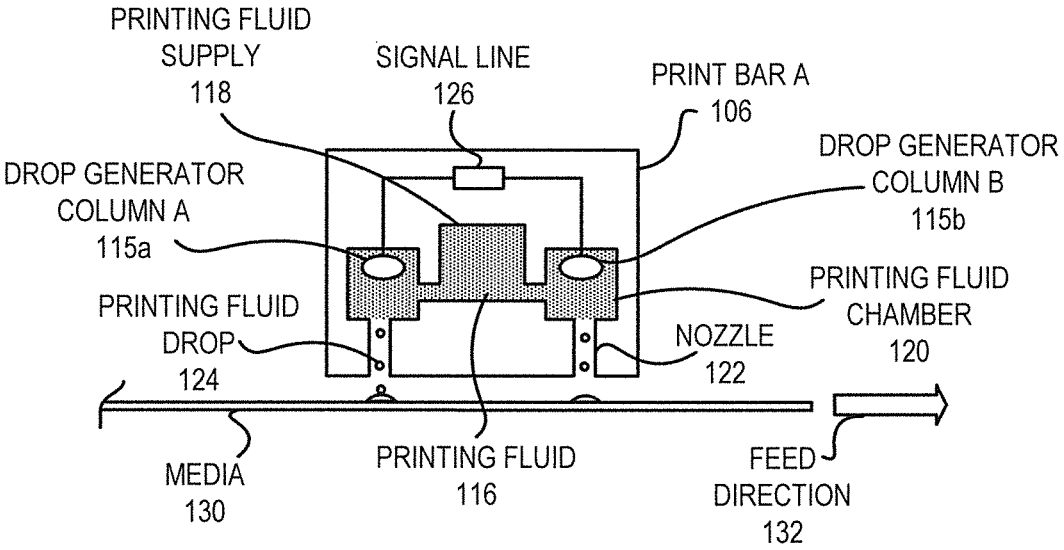
FIG. 1B is a simplified schematic diagram of a print bar depicted in FIG. 1A, according to an example of the present disclosure.

Each of the print bars 106-112 is depicted as including a plurality of drop generators 114 arranged along two parallel columns. The drop generators 114 are depicted as being arranged along a first drop generator column 115*a* and a second drop generator column 115*b*. A relatively small number of drop generators 114 are shown for convenience, but it should be clearly understood that each of the print bars 106-112 may include much larger numbers of drop generators 114, for instance, to be able to print at 600 dpi or more across the width of a media 130. Each of the drop generators 114 may be a resistor (or equivalently, a heating element) or a piezoelectric element that may be individually activated or fired to cause drops of printing fluid to be ejected out of respective nozzles (an example is shown in FIG. 1B). The drop generators 114 may be activated in any manner consistent with known heat generating or piezoelectric actuating drop generators and thus a detailed discussion of a manner in which the drop generators 114 may be activated to cause printing fluid to be ejected is not provided herein.

As discussed in greater detail herein below, the controller 102 also includes a damage mitigating apparatus 104 that is to mitigate damage to the drop generators 114. Particularly, the damage mitigating apparatus 104 is to mitigate damage to the drop generators in printing an image on the media 130 while a file containing the image to be printed is in an image processing pipeline of the printing system 100. In other words, the damage mitigating apparatus 104 is to mitigate damage to the drop generators in printing the image without moving the drop generators 114 with respect to the media 130 in a direction perpendicular to the media 130 feed direction 132 or shifting placement of the image on the media 130. Various manners in which the damage mitigating apparatus 104 may mitigate damage to the drop generators 114 are discussed in detail below.

As also shown in FIG. 1A, the drop generators 114 are to drop printing fluid onto the media 130 as either the media 130 is fed past the print bars 106-112 in the feed direction 132 or the drop generators 114 are moved over the media 140 in a direction opposite the feed direction 132. In either arrangement, any given location on the media 130, may receive printing fluid from the same drop generator 114 and thus, the printing system 100 may be a fixed printing system. In other words, the print bars 106-112 may not be scanned in a direction perpendicular to the feed direction 132. However, the print bars 106-112 may be moved slightly, e.g., half a nozzle width, during a printing operation to allow two-pass printing (one pass in each direction) at twice the resolution of single pass printing. In addition, although particular reference is made throughout the present disclosure that the media 130 is fed in the feed direction 132, it should be understood that the print bars 106-112 may equivalently be moved in the direction opposite the feed direction 132 without departing from a scope of the methods and apparatuses disclosed in the present disclosure.

Turning now to FIG. 1B, there is shown a simplified schematic diagram of a print bar 106, according to an example. It should be understood that the other print bars 108-112 may have similar configurations as the print bar 106 depicted in FIG. 1B. It should also be understood that the print bar 106 depicted in FIG. 1B may include additional elements and/or that the elements depicted therein may be removed and/or modified without departing from a scope of the print bar 106.

Figure 1C:
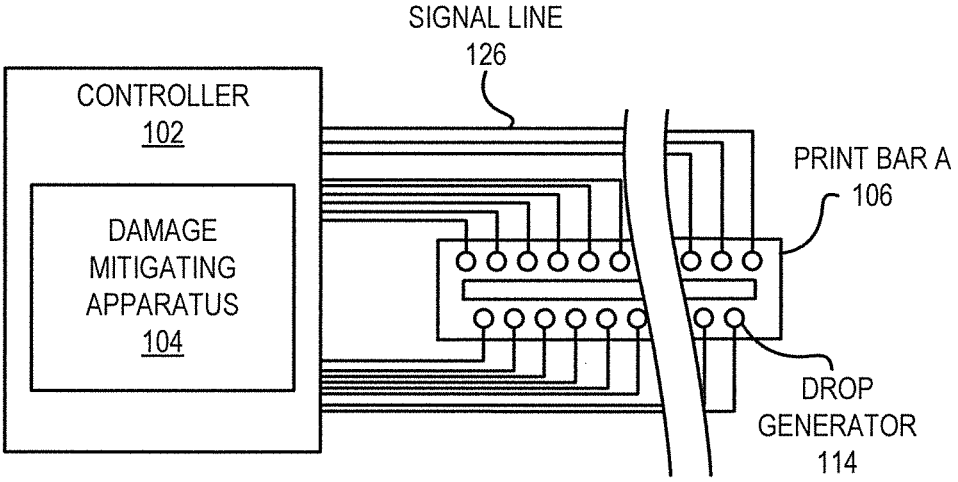
FIG. 1C is a simplified schematic diagram of a manner in which signal lines shown in FIG. 1B may be connected between a controller and drop generators, according to an example of the present disclosure.

As shown in FIG. 1B, the print bar 106 may include multiple drop generators 114, for instance, arranged along two substantially parallel columns 115*a* and 115*b* (two of the drop generators 114 are shown in FIG. 1B). In addition, the drop generators 114 may receive printing fluid 116 from a printing fluid supply 118 that may be connected to a printing fluid reservoir (not shown). Particularly, printing fluid 116 from the printing fluid supply 118 may be supplied into a printing fluid chamber (or equivalently, a firing chamber) 120 and activation of a drop generator 114 may cause a printing fluid drop 124 to be ejected through a nozzle 122 and onto the media 130. As shown in FIG. 1B, the nozzles 122 on opposite sides of the printing fluid supply 118 may have approximately the same widths with respect to each other. According to an example, the drop generator 114 is a resistor that is activated, e.g., heated, through receipt of an electrical signal through a signal line 126. In this example, the heating of the drop generator 114 may cause a bubble to be formed in the printing fluid 116 contained in the printing fluid chamber 120, which may cause a printing fluid drop 124 to be ejected through the nozzle 122. In another example, the drop generator 114 is a piezoelectric element that is activated through receipt of an electrical signal through a signal line 126. A simplified example of a manner in which signal lines 126 may be connected between the controller 102 and the drop generators 114, according to an example, is depicted in FIG. 1C. It should, however, be understood that the controller 102 may control the transmission of electrical signals to each of the drop generators 114 through use of other mechanisms, for instance, multiplexers, etc.

In any regard, the controller 102 may selectively activate the drop generators 114 according to a proper sequence as the media 130 is fed in the feed direction 132 to cause printing fluid 116 to be dropped at the appropriate locations on the media 130 to form a desired image on the media 130. The desired image may include any of text, pictures, lines, drawings, filled-in drawings, etc. As discussed in greater detail herein, the controller 102, and particularly, the damage mitigating apparatus 104, may operate the drop generators 114 in any of a variety of manners to mitigate damage to the drop generators 114.

Figure 2:
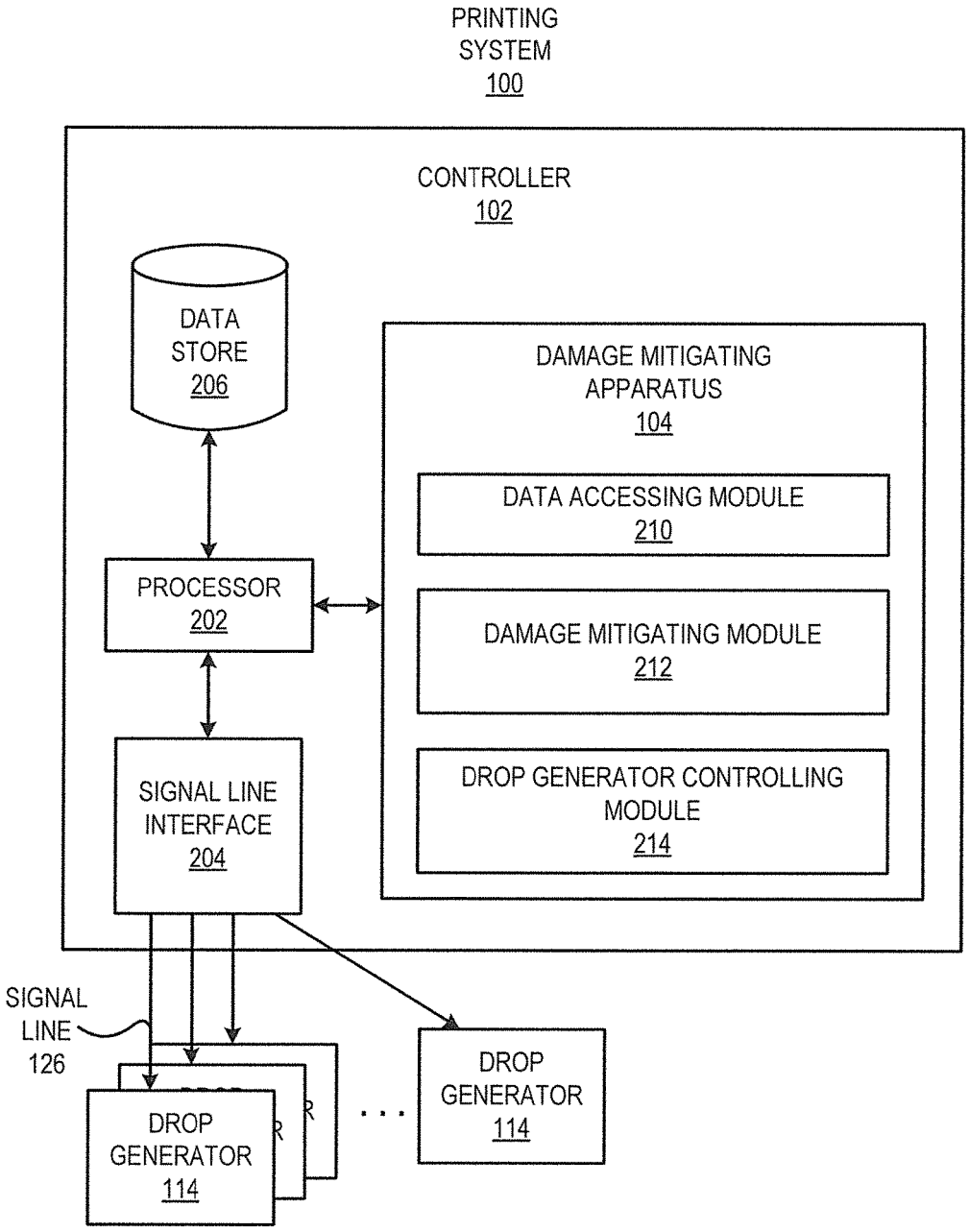
FIG. 2 is a simplified block diagram of the printing system shown in FIG. 1A, according to an example of the present disclosure.

Turning now to FIG. 2, there is shown a simplified block diagram of the printing system 100, according to an example. It should be understood that the printing system 100 depicted in FIG. 2 may include additional elements and that some of the elements depicted therein may be removed and/or modified without departing from a scope of the printing system 100.

As shown in FIG. 2, the controller 102 is depicted as including, in addition to the damage mitigating apparatus 104, a processor 202, a signal line interface 204, and a data store 206. The damage mitigating apparatus 104 is also depicted as including a data accessing module 210, a damage mitigating module 212, and a drop generator controlling module 214. Although not shown, the controller 102 may further include an interface to a network connection, for instance, to enable the processor 202 to access data corresponding to images to be printed. The controller 102 may still further include an interface to an actuator (not shown) that is to control feeding of the media 130.

The processor 202, which may be a microprocessor, a micro-controller, an application specific integrated circuit (ASIC), or the like, is to perform various processing functions in the controller 102. The processing functions may include invoking or implementing the damage mitigating apparatus 104 and particularly, the modules 210-214 of the damage mitigating apparatus 104, as discussed in greater detail herein below. According to an example, the damage mitigating apparatus 104 is a hardware device on which is stored various sets of machine readable instructions. The damage mitigating apparatus 104 may be, for instance, a volatile or non-volatile memory, such as dynamic random access memory (DRAM), electrically erasable programmable read-only memory (EEPROM), magnetoresistive random access memory (MRAM), memristor, flash memory, floppy disk, a compact disc read only memory (CD-ROM), a digital video disc read only memory (DVD-ROM), or other optical or magnetic media, and the like, on which software may be stored. In this example, the modules 210-214 may be software modules, e.g., sets of machine readable instructions, stored in the damage mitigating apparatus 104.

In another example, the damage mitigating apparatus 104 may be a hardware component, such as a chip, and the modules 210-214 may be hardware modules on the hardware component. In a further example, the modules 210-214 may include a combination of software and hardware modules. In a yet further example, the processor 202 may be an ASIC that is to perform the functions of the modules 210-214. In this example, the processor 202 and the damage mitigating apparatus 104 may be a single processing apparatus.

The processor 202 may store data in the data store 206 and may use the data in implementing the modules 210-214. For instance, the processor 202 may store data pertaining to an image that is to be printed onto a medium 130. In any regard, the data store 206 may be volatile and/or non-volatile memory, such as DRAM, EEPROM, MRAM, phase change RAM (PCRAM), memristor, flash memory, and the like. In addition, or alternatively, the data store 206 may be a device that may read from and write to a removable media, such as, a floppy disk, a CD-ROM, a DVD-ROM, or other optical or magnetic media.

The signal line interface 204 may include hardware and/or software to enable the processor 202 to respectively send electrical signals to the drop generators 114 over signal lines 126. Although not shown, the signal line interface 204 may be connected to a power source from which the electrical signals may be transmitted to the respective drop generators 114. In addition, the processor 202 may be connected to an input/output interface (not shown) that may enable the processor 202 to access a network, such as an internal network, the Internet, etc., over which the processor 202 may receive files containing images to be printed. The input/output interface may include a network interface card and/or may also include hardware and/or software to enable the processor 202 to communicate with various input and/or output devices, such as a keyboard, a mouse, a display, another computing device, etc., through which a user may input instructions into the printing system 100.

Various manners in which the processor 202 in general, and the modules 210-214 in particular, may be implemented are discussed in greater detail with respect to the methods 300-900 respectively depicted in FIGS. 3-9. Particularly, FIGS. 3-9, respectively, depict flow diagrams of methods 300-900 for mitigating damage to a plurality of drop generators 114 in a printing system 100, according to various examples. It should be apparent to those of ordinary skill in the art that the methods 300-900 may represent generalized illustrations and that other operations may be added or existing operations may be removed, modified, or rearranged without departing from the scopes of the methods 300-900. Generally speaking, the processor 202 depicted in FIG. 2 may implement any of methods 300-900 through implementation of at least some of the modules 210-214. In addition, each of the methods 400-900 generally includes features that are more specific examples of the features contained in the method 300.

The descriptions of the methods 300-900 are made with reference to the printing system 100 illustrated in FIGS. 1A-2 for purposes of illustration. It should, however, be clearly understood that printing systems having other configurations may be implemented to perform any of the methods 300-900 without departing from the scopes of the methods 300-900.

Figure 3:
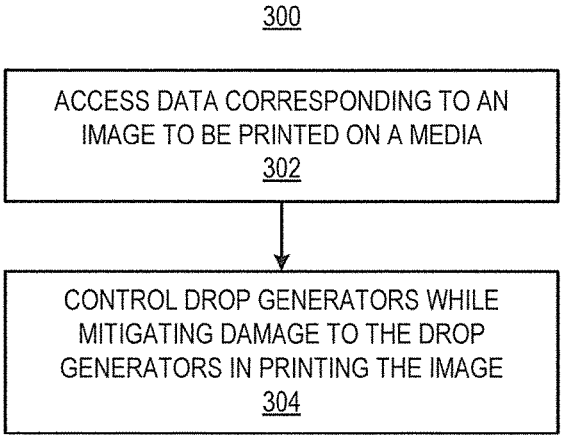
FIGS. 3-9, respectively, are flow diagrams of methods for mitigating damage to a plurality of drop generators, according to examples of the present disclosure.

With reference first to the method 300 depicted in FIG. 3, at block 302, data corresponding to an image to be printed on a media 130 may be accessed. For instance, data representing the image that has been processed for printing by the printing system to be printed may be stored in the data store 206. In this example, the data accessing module 210 may access the data from the data store 206. In other examples, the data accessing module 210 may access the data from other sources, for instance, from an external data store over a local area network, over a wide area network, from an externally attached storage device, etc.

At block 304, the drop generators 114 may be controlled to print the image on the media while mitigating damage to the plurality of drop generators 114 and without shifting placement of the printed image on the media 130 or shifting the plurality of drop generators in a direction perpendicular to a feed direction of the media 130. For instance, the damage mitigating module 212 may determine how the drop generators 114 are to be operated to mitigate damage to the drop generators 114. In other words, the damage mitigating module 212 may determine which of the drop generators 114 are to be activated at which times for an image printing operation to cause the drop generators 114 to wear substantially evenly with respect to each other, without shifting placement of the printed image on the media 130 or shifting the drop generators 114 in a direction that is perpendicular to the feed of direction 132 of the media 130. That is, the damage mitigating module 212 may determine the timing at which selected drop generators 114 or groups of drop generators 114 are to be activated to print the image on the media 130 such that the margins between the edges of the media 130 and the printed image are sized as originally intended. In other words, therefore, the drop generator control while mitigating damage at block 304 may be achieved without printing the image with an entirely shifted set of drop generators 114.

In addition, in accordance with the determination as to how the drop generators 114 are to be operated, the drop generator controlling module 214 may control the drop generators 114 individually or in respective groups to drop printing fluid onto the media 130 at appropriate times while the media 130 is fed past the drop generators 114 to thus cause the image to be printed onto the media 130. Various examples in which the damage mitigating module 212 may make this determination and the drop generator controlling module 214 may control the drop generators 114 according to the determination are discussed in greater detail below with respect to the methods 400-900.

According to an example, the damage mitigating module 212 may determine that certain ones of the drop generators 114 are to be activated instead of other ones of the drop generators 114 in printing the image to thus cause the drop generators 114 to wear substantially evenly with respect to each other. In addition, the damage mitigating module 212 may make this determination such that the drop generators 114 wear substantially evenly with respect to each other over the course of printing a relatively large number of images, e.g., over more than 100 images. Thus, for instance, although a set of the drop generators 114 may be activated a substantially larger number of times than another set of the drop generators 114 to print a particular image, the damage mitigating apparatus 104 may implement a drop generator utilization technique, as disclosed herein, that substantially prevents a group of the drop generators 114 from being activated much more often than other groups of the drop generators 114 to thereby mitigate damage to the drop generators 114.

According to an example, an initial determination of which of the drop generators 114 are to be activated at which times to print the image may be made prior to the determination by the damage mitigating module 212. The initial determination may therefore be the order and timing (e.g., sequence) at which the drop generators 114 are to be activated under a nominal printing operation. In other words, the initial determination may identify a printing operation that would be performed if the damage mitigating operation disclosed herein were not implemented. As such, in one regard, the control of the drop generators at block 304 represents use of sets of drop generators 114 that differs from their use in a nominal printing operation.

In addition, because the printing system 100 may be a fixed printing system and thus, the print bars 106-112 on which the drop generators 114 are positioned may not move in a direction perpendicular to the feed direction 132 during a printing operation, control of the drop generators 114 to mitigate damage at block 304 may be achieved without moving either the print bars 106-112 or the media 130 in a direction perpendicular to the feed direction 132, and thus the drop generators 114, with respect to the media 130. Moreover, block 304 may be applied to the drop generators 114 in a single one of the print bars 106 or may be applied to the drop generators 114 respectively in multiple ones of the print bars 106-112.

Figure 4:
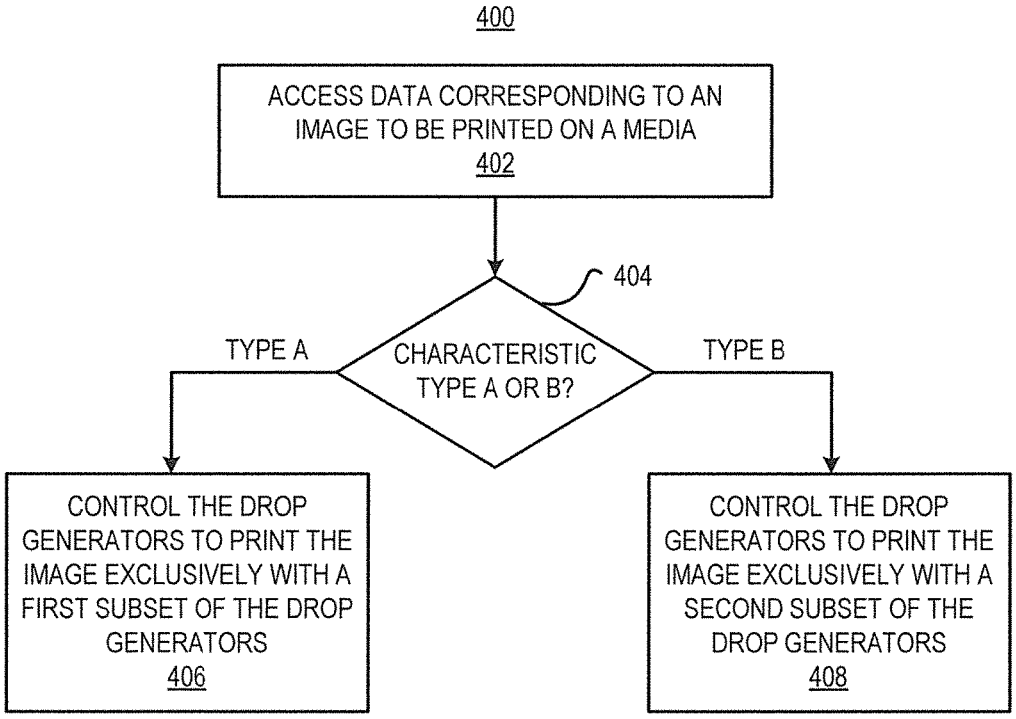

With reference now to the method 400 depicted in FIG. 4, at block 402, data corresponding to an image to be printed on a media 130 may be accessed. The data may be accessed in any of the manners discussed above with respect to block 302 in the method 300 depicted in FIG. 3.

At block 404, a characteristic type of the image to be printed may be determined. For instance, the data accessing module 210 may determine a characteristic type of the image to be printed, in which the characteristic type may be, for instance, whether the image includes a section that is intended to be printed primarily by a particular set of drop generators 114 in a highly repetitive manner, e.g., a relatively long straight line, whether the image is intended to be printed by a relatively large set of drop generators 114 without causing any subset of the drop generators 114 to be activated substantially more often than any other subset of the drop generators 114, e.g., a filled in or solid section, etc. By way of particular example, a characteristic type of the image to be printed may be that the image is an engineering drawing, which may include relatively long lines that extend near the edges of the media 130 to form borders around drawings contained within the borders and thus may require highly repetitive use of a set of drop generators 114 with respect to other drop generators 114. As another example, a characteristic type of the image to be printed may be that the image contains relatively large solid sections.

According to an example, and as shown in FIG. 4, at block 404, a determination may be made as to whether the image to be printed has either a first characteristic type (A) or a second characteristic type (B). As discussed in the example above, a first characteristic type may be that the image to be printed is an engineering drawing, e.g., a computer aided drawing, and a second characteristic type may be that the image to be printed is an image that contains relatively large solid sections.

As indicated at block 406, in response to a determination being made at block 404 that the image to be printed has a first characteristic type, control of the drop generators 114 may include controlling the drop generators 114 to print the image exclusively with a first subset of the drop generators 114. Alternatively, as indicated at block 408, in response to a determination being made at block 404 that the image to be printed has a second characteristic type, control of the drop generators 114 may include controlling the drop generators 114 to print the image exclusively with a second subset of the drop generators 114. The first subset of drop generators 114 may be non-overlapping with the second subset of the plurality of drop generators 114. In addition, blocks 406 and 408 may be applied to the drop generators 114 in a single one of the print bars 106 or may be applied to the drop generators 114 respectively in multiple ones of the print bars 106-112.

According to an example, the first subset of drop generators 114 are the drop generators 114 located along one column 115*a* of a print bar 106 and the second subset of drop generators 114 are the drop generators 114 located along the other column 115*b* of the print bar 106, for instance, as shown in FIG. 1A. By way of particular example, all of the lines of an engineering drawing, which typically do not include large sections of filled areas, may be printed with the drop generators 114 located along a first column 115*a* of a print bar 106. In this example, all of the features of an image containing sections of filled areas may be printed with the drop generators 114 located along a second column 115*b* of the print bar 106. As some of the drop generators 114 located in the first column 115*a* of the print bar 106, for instance, may be used to print a large number of borders in engineering drawings, those drop generators 114 may be more likely to be damaged at a faster rate as compared with other drop generators 114. However, because those drop generators 114 may be limited to printing engineering drawings and thus may not likely print filled areas, the effects of damage, e.g., burn-in, on those drop generators 114 may not be readily visible. In addition, because the drop generators 114 located in the second column 115*b* may not be used to print the borders of engineering drawings, those drop generators 114 may be less likely to experience damage. As such, the drop generators 114 located in the second column 115*b* may be used to print filled areas without causing detrimental effects, e.g., banding, in those filled areas of the image caused by damage to, e.g., burn-in of, the drop generators 114 located in the first column 115*a*.

According to an example, a bad drop generator 114 located along the first column 115*a* of a print bar 106 may be replaced with a drop generator 114 located across from the bad drop generator 114 in the second column 115*b* of the print bar 106 during printing operations. A bad drop generator may be a drop generator that has failed or is otherwise operating improperly.

Although the method 400 is described with respect to two characteristic types, it should be understood that the method 400 may be implemented through consideration of any reasonably suitable number of characteristic types. That is, at block 404, for instance, a determination may be made as to whether the image to be printed is of any number of different characteristic types. In addition, blocks 406 and 408 may be implemented responsive to the image to be printed being any of the number of different characteristic types. Alternatively, the method 400 may include drop generator 114 control options in addition to blocks 406 and 408 depending upon the characteristic type of the image to be printed. The additional control options may include, for instance, control of other subsets of the drop generators 114.

In other examples in which the image to be printed does not contain any of the characteristic types considered at block 404, the drop generators 114 may be controlled to be activated in a manner other than through implementation of blocks 406 or 408. In other words, the drop generators 114 may be operated in a default manner in which the drop generators 114 are operated according to a nominal printing operation to print the image.

Figure 5:
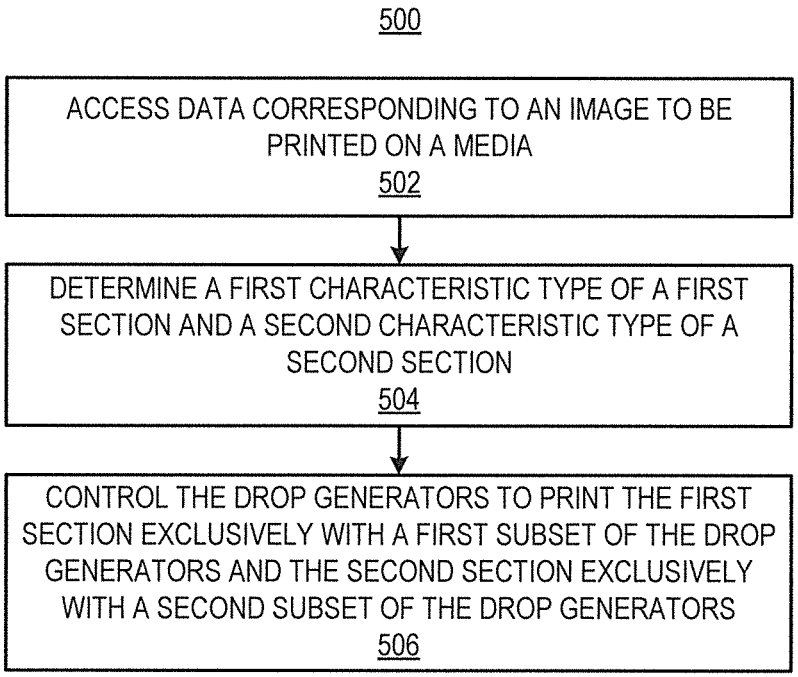

Turning now to the method 500 depicted in FIG. 5, at block 502, data corresponding to an image to be printed on a media 130 may be accessed. The data may be accessed in any of the manners discussed above with respect to block 302 in the method 300 depicted in FIG. 3.

At block 504, a first characteristic type of a first section and a second characteristic type of a second section of the image to printed may be determined. For instance, the image to be printed may include multiple sections in which at least two of the sections include different characteristic types from each other. In addition, the data accessing module 210 may determine the different characteristic types of the sections of the image to be printed. The characteristic types may include any of the characteristic types discussed above with respect to the method 400.

At block 506, a first subset of the drop generators 114 may be controlled to exclusively print the first section of the image and a second subset of the drop generators 114 may be controlled to exclusively print the second section of the image. Particularly, for instance, the drop generator controlling module 214 may control the drop generators 114 in this manner. The first subset of drop generators 114 may be those drop generators 114 located along a first column 115*a* of a print bar 106 and the second subset of drop generators 114 may be those drop generators 114 located along a second column 115*b* of the print bar 106. In addition, the first subset of drop generators 114 may include a non-overlapping set of drop generators 114 as compared with the second subset of the plurality of drop generators 114. Moreover, block 506 may be applied to the drop generators 114 in a single one of the print bars 106 or may be applied to the drop generators 114 respectively in multiple ones of the print bars 106-112.

By way of particular example, the first characteristic type is a line drawing section, e.g., an engineering drawing, and the second characteristic type is a filled area section of the image. In this example, printing of the image using the first subset of the drop generators 114 to exclusively print the first section and using the second subset of the drop generators to exclusively print the second section may mitigate effects of drop generator damage, such as burn-in, for at least the reasons discussed above with respect to the method 400.

Figure 6:
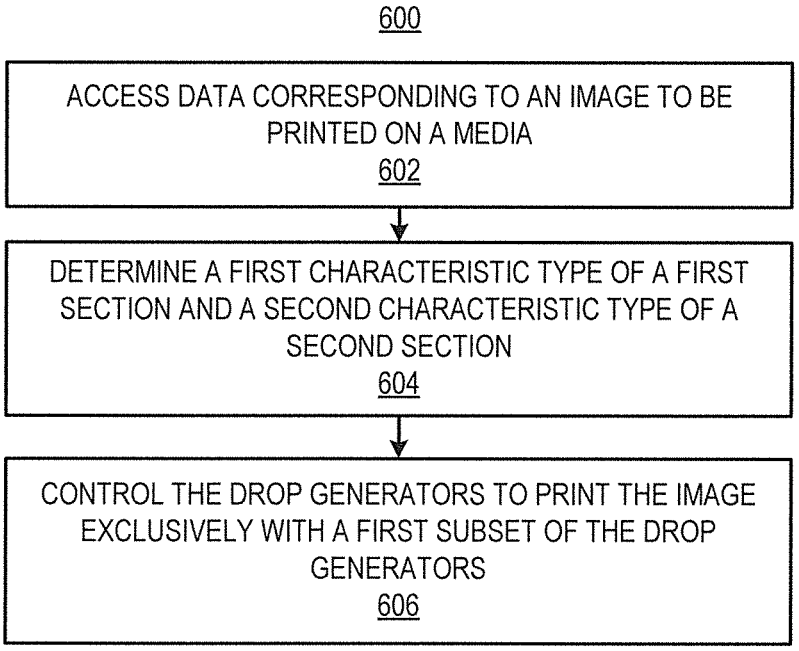

Turning now to the method 600 depicted in FIG. 6, at block 602, data corresponding to an image to be printed on a media 130 may be accessed. The data may be accessed in any of the manners discussed above with respect to block 302 in the method 300 depicted in FIG. 3.

At block 604, a first characteristic type of a first section and a second characteristic type of a second section of the image to printed may be determined. For instance, the image to be printed may include multiple sections in which at least two of the sections include different characteristic types from each other. In addition, the data accessing module 210 may determine the different characteristic types of the sections of the image to be printed. The characteristic types may include any of the characteristic types discussed above with respect to the method 400.

At block 606, a first subset of the drop generators 114 may be controlled to exclusively print both the first section of the image and the second section of the image. Particularly, for instance, the drop generator controlling module 214 may control the drop generators 114 in this manner. The first subset of drop generators 114 may be those drop generators 114 located along a first column 115*a* of a print bar 106 and the second subset of drop generators 114 may be those drop generators 114 located along a second column 115*b* of the print bar 106. In addition, the first subset of drop generators 114 may include a non-overlapping set of drop generators 114 as compared with the second subset of the plurality of drop generators 114. Moreover, block 606 may be applied to the drop generators 114 in a single one of the print bars 106 or may be applied to the drop generators 114 respectively in multiple ones of the print bars 106-112.

By way of particular example, the first characteristic type is a line drawing section, e.g., an engineering drawing, and the second characteristic type is a filled area section of the image. In this example, printing of the image using the first subset of the drop generators 114 to exclusively print the first section and the second section may mitigate effects of drop generator damage, such as burn-in, for at least the reasons discussed above with respect to the method 400.

Figure 7:
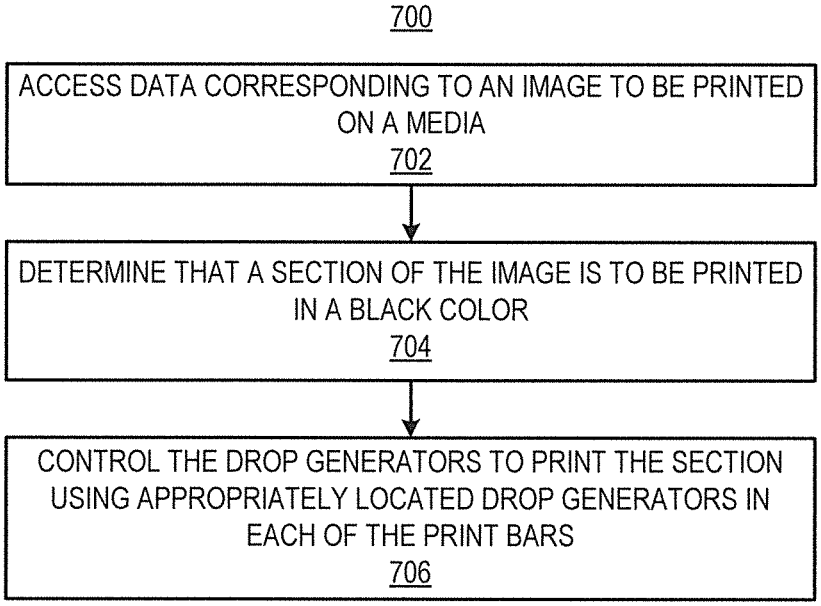

With reference now to the method 700 in FIG. 7, at block 702, data corresponding to an image to be printed on a media 130 may be accessed. The data may be accessed in any of the manners discussed above with respect to block 302 in the method 300 depicted in FIG. 3.

At block 704, a determination may be made that a section of the image is to be printed in a black color. The section of the image may include a portion of the image or the entire image. In addition, for instance, the data accessing module 210 may make this determination based upon an analysis of the data corresponding to the image. This determination may also include a determination of the location in the image of the section of the image that is to be printed in the black color.

At block 706, the drop generators 114 appropriately located in each of the first print bar 106, the second print bar 108, the third print bar 110, and the fourth print bar 112 may be controlled to print the determined section. That is, instead of exclusively activating the drop generators 114 in the print bar 106 that is supplied with black colored printing fluid to be deposited, the drop generators 114 in the print bars 108-112 that are supplied with other colored printing fluids, e.g., yellow, cyan, and magenta, may be activated with the print bar 106 to print the determined section to have the black color. That is, the appropriately located drop generators 114, for instance, the drop generators 114 located along a common line extending in the direction in which the media 130 is fed, may each drop printing fluid such that the combination of the printing fluids along common locations on the media 130 may have a black color.

Figure 8:
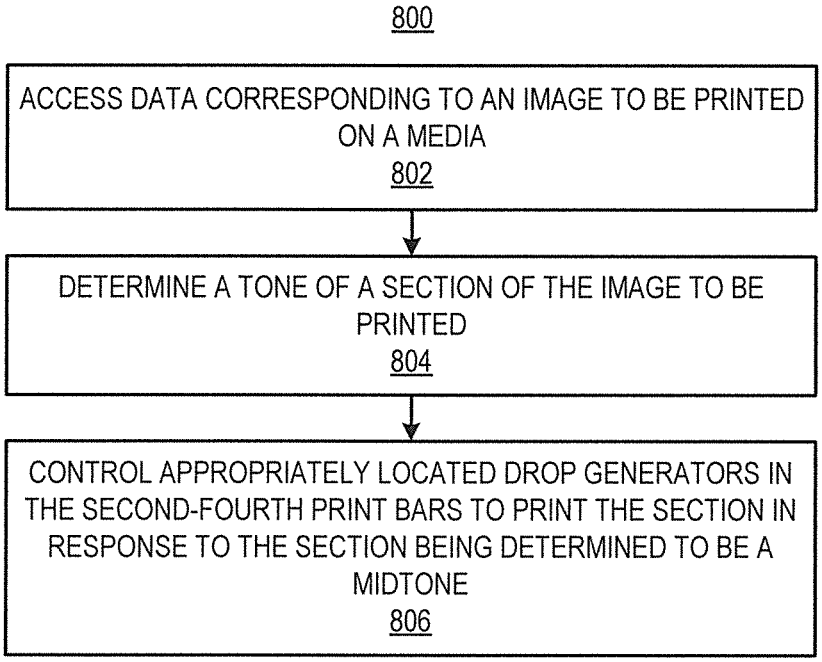

With reference now to the method 800 in FIG. 8, at block 802, data corresponding to an image to be printed on a media 130 may be accessed. The data may be accessed in any of the manners discussed above with respect to block 302 in the method 300 depicted in FIG. 3.

At block 804, a determination may be made of a tone of a section of the image. The section of the image may include a portion of the image or the entire image. In addition, for instance, the data accessing module 210 may make this determination based upon an analysis of the data corresponding to the image. This determination may also include a determination of the location in the image of the section of the image having the determined tone.

At block 806, appropriately located drop generators 114 in each of the second print bar 108, the third print bar 110, and the fourth print bar 112 may be controlled to print the determined section in response to the section being determined to be a midtone. A midtone may be defined as a tone between and not including approximately complete black and approximately complete white. In addition, as discussed above, the first print bar 106 may be supplied with a black colored printing fluid, the second print bar 108 may be supplied with a cyan colored printing fluid, the third print bar 110 may be supplied with a magenta colored printing fluid, and the fourth print bar 112 may be supplied with a yellow colored printing fluid. As noted at block 806, the appropriately located drop generators 114 in each of the print bars 108-112 other than the first print bar 106 may be implemented to print the section of the image containing a midtone. In other words, the section, when it contains a midtone, may be printed using printing fluids having colors other than black. In one regard, therefore, the drop generators 114 in the first print bar 106, which may be supplied with black colored printing fluid, may be exclusively used to print nearly complete black colors and nearly complete white colors. An example of the utilization of the different colored printing fluids for different tones is provided below in Table 1.

TABLE 1

| Tone | Black (K) % | Cyan (C) % | Magenta (M) % | Yellow (Y) % |
|---|---|---|---|---|
| White | 5 | 2 | 2 | 2 |
| Nearly White | 3 | 8 | 8 | 8 |
| Midtone | 0 | 8 | 8 | 8 |
| Midtone | 0 | 15 | 15 | 15 |
| Midtone | 0 | 30 | 30 | 30 |
| Nearly Black | 0 | 40 | 40 | 40 |
| Black | 10 | 40 | 40 | 40 |

As shown in Table 1, the tone may increase from white to black and depending upon the tone, various amounts of the different colored printing fluids may be used in printing that tone of the color black.

Figure 9:
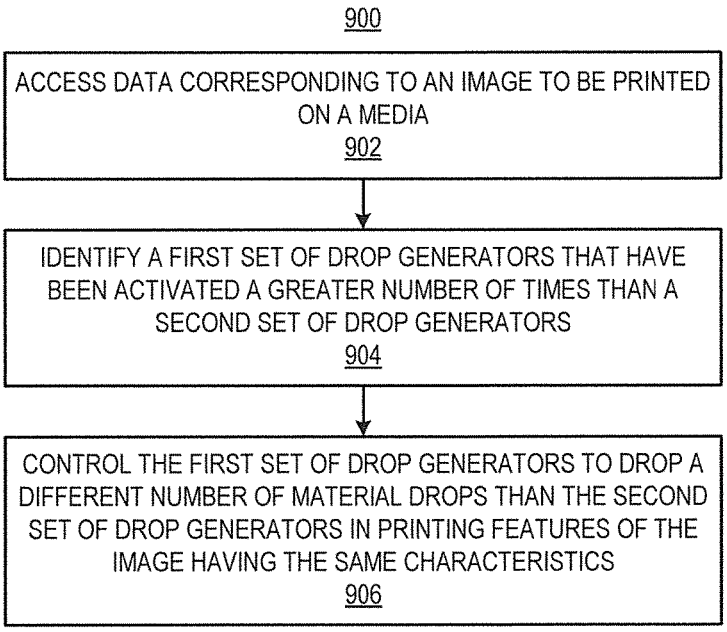

With reference now to the method 900 in FIG. 9, at block 902, data corresponding to an image to be printed on a media 130 may be accessed. The data may be accessed in any of the manners discussed above with respect to block 302 in the method 300 depicted in FIG. 3.

At block 904, an identification may be made of a first set of drop generators that have been activated a greater number of times than a second set of drop generators in a single print bar 106. For instance, the damage mitigating module 212 may make this identification based upon a profiling of the drop generators 114 in the print bar 106. Particularly, the damage mitigating module 212 may count the number of times each of the drop generators 114 in the print bar 106 have been fired and may determine which of the drop generators 114 are likely to have a higher likelihood of damage, e.g., burn-in, as well as the severity of the damage based upon the count. Thus, for instance, the damage mitigating module 212 may identify the potentially damaged, e.g., burnt-in, drop generators 114 as those drop generators 114 that have been activated more than a predetermined number of times. As another example, the damage mitigating module 212 may identify the potentially damaged, e.g., burnt-in, drop generators 114 as those drop generators 114 that have been activated more than a predetermined number of times over the number of times that other drop generators 114 have been activated.

In addition, the damage mitigating module 212 may determine a correction factor for the potentially damaged drop generators 114. The correction factor may be an increase in the number of times that the potentially damaged drop generators 114 are to be activated in comparison to other drop generators 114 for a given printing operation.

At block 906, the first set of drop generators, which may be the drop generators that are potentially damaged, e.g., burnt-in, may be controlled to drop a different number of printing fluid drops than the second set of drop generators, which may be the drop generators that are not or are potentially less damaged, in printing features of the image having the same characteristics. That is, for instance, the drop generator controlling module 214 may activate the first set of drop generators a different number of times than the second set of drop generators to print the same color (e.g., RGB) value. By way of particular example, the drop generator controlling module 214 may create an RGB value of 128, 128, 128 by using 1 black colored drop per 600 dpi pixel with the second set of drop generators but may use 1.1 black colored drops per 600 dpi pixel with the first set of drop generators. As another example, the drop generator controlling module 214 may create an RGB value of 128, 128, 128 by using 1 black colored drop per 600 dpi pixel with the second set of drop generators but may use 0.9 black colored drops per 600 dpi pixel with the first set of drop generators. In one regard, therefore, the method 900 may substantially equalize the amount of printing fluid deposited from drop generators 114 that are damaged and those that are operating normally, thus mitigating the effects of the damage.

The first set of drop generators may not overlap with the second set of the drop generators. In addition, block 906 may be applied to the drop generators 114 in a single one of the print bars 106 or may be applied to the drop generators 114 respectively in multiple ones of the print bars 106-112.

According to a further example, a user may be notified that a set of drop generators may or may likely become damaged and may also be provided with instructions to manually delay and/or mitigate the damage. For instance, the damage mitigating apparatus 104 may output, e.g., display, a message for the user that repeated pattern printing will likely result in print bar degradation and that the user should thus rotate some of the print bars or modules of the print bars.

Some or all of the operations set forth in the methods 300-900 may be contained as utilities, programs, or subprograms, in any desired computer accessible medium. In addition, the methods 300-900 may be embodied by computer programs, which may exist in a variety of forms both active and inactive. For example, they may exist as machine readable instructions, including source code, object code, executable code or other formats. Any of the above may be embodied on a non-transitory computer readable storage medium.

Examples of non-transitory computer readable storage media include computer system RAM, ROM, EPROM, EEPROM, and magnetic or optical disks or tapes. It is therefore to be understood that any electronic device capable of executing the above-described functions may perform those functions enumerated above.

Figure 10:
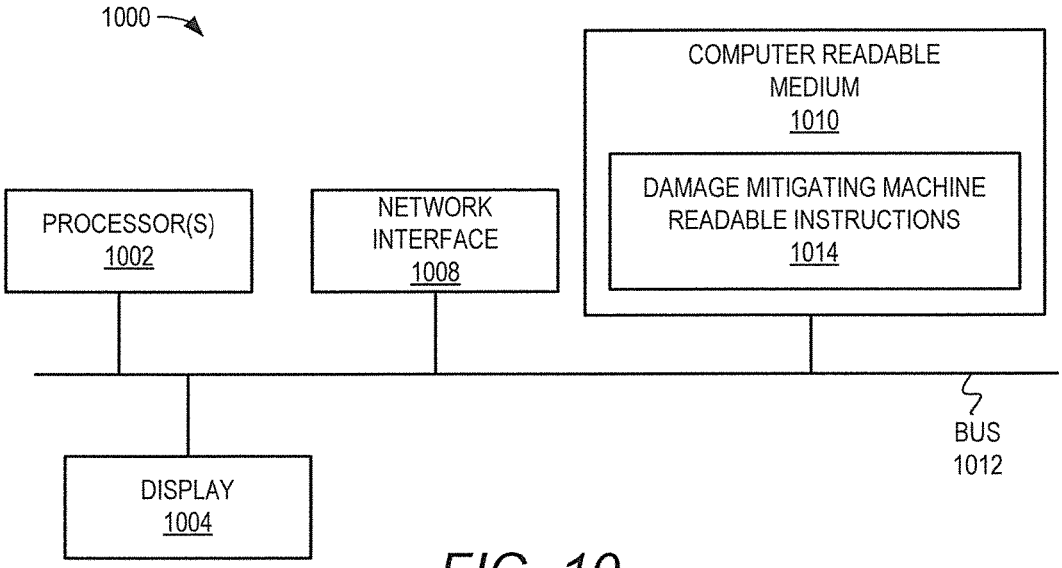
FIG. 10 is schematic representation of a computing device, which may be employed to perform various functions of the controller depicted in FIG. 2, according to an example of the present disclosure.

Turning now to FIG. 10, there is shown a schematic representation of a computing device 1000, which may be employed to perform various functions of the controller 102 depicted in FIG. 2, according to an example. The computing device 1000 may include a processor 1002, a display 1004, such as a monitor; a network interface 1008, such as a Local Area Network LAN, a wireless 802.11x LAN, a 3G mobile WAN or a WiMax WAN; and a computer-readable medium 1010. Each of these components may be operatively coupled to a bus 1012. For example, the bus 1012 may be an EISA, a PCI, a USB, a FireWire, a NuBus, or a PDS.

The computer readable medium 1010 may be any suitable medium that participates in providing instructions to the processor 1002 for execution. For example, the computer readable medium 1010 may be non-volatile media, such as an optical or a magnetic disk; volatile media, such as memory. The computer-readable medium 1010 may also store a damage mitigating machine readable instructions 1014, which may perform some or all of the methods 300-900 and may include the modules 210-214 of the damage mitigating apparatus 104 depicted in FIG. 2. In this regard, the damage mitigating machine readable instructions 1014 may include a data accessing module 210, a damage mitigating module 212, and a drop generator controlling module 214.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. A method for mitigating damage to a plurality of drop generators in a printing system, said method comprising:

accessing data corresponding to an image to be printed on a media by the printing system; and controlling the plurality of drop generators to print the image on the media while mitigating damage to the plurality of drop generators, based on a determination of which of the plurality of drop generators are worn compared to other drop generators in the printing system, and without shifting placement of the image on the media or shifting the plurality of drop generators in a direction perpendicular to a feed direction of the media;

wherein controlling the plurality of drop generators further comprises controlling the plurality of drop generators to print a section of the image exclusively with a first subset of the plurality of drop generators or a second subset of the plurality of drop generators depending upon a determined characteristic type of the section of the image to be printed.

2. The method according to claim 1, further comprising:

determining a characteristic type of the image to be printed; and wherein controlling the plurality of drop generators to print the section of the image exclusively with the first subset of the plurality of drop generators is in response to the section of the image to be printed having a first characteristic type and printing the section of the image exclusively with the second subset of the plurality of drop generators in response to the section of the image to be printed having a second characteristic type.

3. The method according to claim 2, wherein the second subset of the plurality of drop generators includes a non-overlapping set of drop generators as compared with the first subset of the plurality of drop generators.

4. The method according to claim 1, wherein the first subset and the second subset of the plurality of drop generators are arranged along two columns along a print bar, said method further comprising:

determining a characteristic type of the image to be printed; and wherein controlling the plurality of drop generators to print the section of the image exclusively with the plurality of drop generators arranged along one of the two columns in response to the section of the image having a first characteristic type and to print the section of the image exclusively with the plurality of drop generators of the other of the two columns in response to the section of the image having a second characteristic type.

5. The method according to claim 1, wherein the section of the image to be printed includes a first section and a second section, said method further comprising:

determining a first characteristic type of the first section and a second characteristic type of the second section, wherein the first characteristic type differs from the second characteristic type; and wherein controlling the plurality of drop generators to print the first section exclusively with the first subset of the plurality of drop generators and the second section exclusively with the second subset of the plurality of drop generators.

6. The method according to claim 1, wherein the section of the image to be printed includes a first section and a second section, said method further comprising:

determining a first characteristic type of the first section and a second characteristic type of the second section, wherein the first characteristic type differs from the second characteristic type; and wherein controlling the plurality of drop generators to print the first section and the second section exclusively with the first subset of the plurality of drop generators.

7. The method according to claim 1, wherein the first subset of the plurality of drop generators is arranged on a first print bar to print a first color, the second subset of the plurality of drop generators is arranged on a second print bar to print a second color, a third subset of the plurality of drop generators is arranged on a third print bar to print a third color, and a fourth subset of the plurality of drop generators is arranged on a fourth print bar to print a black color, said method further comprising:

determining that the section of the image is to be printed in a black color; and wherein controlling the plurality of drop generators to print the section of the image using appropriately located drop generators in each of the first print bar, the second print bar, the third print bar, and the fourth print bar.

8. The method according to claim 1, wherein the first subset of the plurality of drop generators is arranged on a first print bar to print a black colored printing fluid, the second subset of the plurality of drop generators is arranged on a second print bar to print a second colored printing fluid, a third subset of the plurality of drop generators is arranged on a third print bar to print a third colored printing fluid, and a fourth subset of the plurality of drop generators is arranged on a fourth print bar to print a fourth colored printing fluid, said method further comprising:

determining a tone of a section of the section of the image to be printed; and wherein controlling the plurality of drop generators to print the section of the image exclusively using appropriately located drop generators in each of the second print bar, the third print bar, and the fourth print bar in response to the section of the image being determined to be a midtone.

9. The method according to claim 1, wherein the plurality of drop generators are arranged on a single print bar, said method further comprising:

identifying a first set of the plurality of drop generators that have been activated a greater number of times than a second set of the plurality of drop generators; and mitigating effects of damage to the plurality of drop generators by controlling the first set of the plurality of drop generators to drop a different number of printing fluid drops than the second set of the plurality of drop generators in printing features of the section of the image having same characteristic type.

10. An apparatus for mitigating damage to a plurality of drop generators in a printing system, said apparatus comprising:

a data accessing module to access data corresponding to an image to be printed on a media by the printing system and to determine a characteristic type of at least a section of the image to be printed;

a drop generator controlling module to control the plurality of drop generators to print the image on the media while mitigating damage to the plurality of drop generators, based on a determination of which of the plurality of drop generators are worn compared to other drop generators in the printing system, and without shifting placement of the image on the media or shifting the plurality of drop generators in a direction perpendicular to a feed direction of the media, wherein the drop generator controlling module is to control the plurality of drop generators to print at least the section of the image exclusively with either a first subset of the plurality of drop generators and a second subset of the plurality of drop generators depending upon the determined characteristic type of at least the section of the image to be printed; and a processor to implement the data accessing module and the drop generator controlling module.

11. The apparatus according to claim 10, wherein the drop generator controlling module is to control the plurality of drop generators to print the image exclusively with the first subset of the plurality of drop generators in response to the at least the section of the image being determined to have a first characteristic type and to control the plurality of drop generators to print the image exclusively with the second subset of the plurality of drop generators in response to the at least the section of the image being determined to have a second characteristic type.

12. The apparatus according to claim 10, wherein the plurality of drop generators are arranged along two columns along a print bar and wherein the first subset of the plurality of drop generators are the plurality of drop generators arranged along one of the two columns and the second subset of the plurality of drop generators are the plurality of drop generators arranged along the other of the two columns.

13. The apparatus according to claim 10, wherein the data accessing module is further to determine that a first section of the image has a first characteristic type and that a second section of the image has second characteristic type, and wherein the drop generator controlling module is to control the plurality of drop generators to print the first section exclusively with the first subset of the plurality of drop generators and the second section exclusively with the second subset of the plurality of drop generators.

14. A non-transitory computer readable storage medium on which is stored machine readable instructions that when executed by a processor cause the processor to:

access data corresponding to an image to be printed on a media by a printing system having an array of drop generators; and control the array of drop generators to print the image on the media while mitigating damage to the array of drop generators, based on a determination of which of a plurality of drop generators in the array of drop generators are worn compared to other drop generators in the printing system, without shifting placement of the image on the media or shifting the array of drop generators in a direction perpendicular to a feed direction of the media;

wherein to control the array of drop generators further comprises control the array of drop generators to print a section of the image exclusively with a first subset of the plurality of drop generators or a second subset of the plurality of drop generators depending upon a determined characteristic type of the section of the image to be printed.

15. The non-transitory computer readable storage medium according to claim 14, wherein the machine readable instructions are further to cause the processor to:

determine a characteristic type of the image to be printed; and control the array of drop generators to print the image exclusively with the first subset of the plurality of drop generators in response to the section of the image to be printed having a first of the determined characteristic type and printing the section of the image exclusively with the second subset of the plurality of drop generators in response to the section of the image to be printed having a second of the determined characteristic type.

* * * * *